US005782185A

United States Patent [19]

Frahm et al.

[11] Patent Number: 5,782,185

[45] Date of Patent: Jul. 21, 1998

[54] PLAY AND STORAGE TABLE

[75] Inventors: Søren Xerxes Frahm; Jan Ryaa, both of Billund, Denmark

[73] Assignee: INTERLEGO AG, Baar, Switzerland

[21] Appl. No.: 384,423

[22] Filed: Feb. 6, 1995

[30] Foreign Application Priority Data

Feb. 9, 1994 [DK] Denmark ..... 0168/94

[51] Int. Cl.[6] ..... A47B 85/00

[52] U.S. Cl. ..... 108/25; 446/75

[58] Field of Search ..... 108/25, 26, 143, 108/102, 90; 312/204, 308, 330.1; 446/75, 85; 273/309, 287

[56] References Cited

U.S. PATENT DOCUMENTS

| | | | |
|---|---|---|---|
| 1,529,482 | 3/1925 | Hall . | |
| 2,128,209 | 8/1938 | Johannsen . | |
| 2,560,300 | 7/1951 | Miller . | |
| 2,708,145 | 5/1955 | Anderson . | |
| 2,845,316 | 7/1958 | Bailey . | |
| 3,003,840 | 10/1961 | Katzin | 312/308 X |
| 3,736,884 | 6/1973 | Kohner | 108/129 X |
| 4,872,410 | 10/1989 | Lilly | 108/26 |
| 4,972,781 | 11/1990 | Montgomery et al. | 108/25 |
| 5,055,081 | 10/1991 | Nayak | 108/26 X |
| 5,218,912 | 6/1993 | Buske | 108/26 |

FOREIGN PATENT DOCUMENTS

| | | | |
|---|---|---|---|
| 8908011 | 8/1989 | European Pat. Off. . | |
| 940286 | 12/1948 | France | 108/90 |
| 518273 | 2/1955 | France | 108/90 |
| 2648994 | 1/1991 | France . | |
| 145314 | 7/1920 | United Kingdom | 108/26 |
| 1123927 | 8/1968 | United Kingdom . | |

*Primary Examiner*—Jose V. Chen

*Attorney, Agent, or Firm*—Kane, Dalsimer, Sullivan, Kurucz, Levy, Eisele and Richard, LLP

[57] ABSTRACT

The upper side of the tabletop (11) of the play table is formed with storage depressions (14) for the storage of e.g. toy building blocks (30). The play table has slidable building plates (20) having cylindrical coupling knobs (21) on which the toy building blocks (30) may be built. The building plates (20) are slidable between a closed position in which they cover the storage depressions (14), and an open position providing access to the depressions. The legs (40–43) of the play table are pivotally mounted so that in a folded-up position they are disposed below and in parallel with the long edges (13) of the tabletop, and in an unfolded position the legs slope outwardly so that the table stands stably.

7 Claims, 2 Drawing Sheets

PLAY AND STORAGE TABLE

The invention concerns a play table, in particular for children, and wherein the upper side of the tabletop includes one or more depressions suitable for accommodating the children's toys, e.g. toy building blocks, and wherein the upper side of the tabletop moreover has a face having a first type of coupling means, e.g. in the form of projecting knobs arranged in a two-dimensional, modular pattern, so that said face serves as a building plate for the building thereon of toy building elements having coupling means of a second type which are complementary to the first type of coupling means. During play with the building blocks at such a play table, the storage depression may hold a larger or minor number of toy building blocks, and the children pick out the building blocks from the depression and build them together on the coupling knobs of the building plate. When the play is over, the toy building blocks may be placed in the storage depression again.

Such play tables are known from Danish Design Registrations No. MR 1077 1990 and No. MR 1078 1990, each of which shows a stationary play table which does not lend itself for being transported with toy building blocks in the depressions, because no cover is provided for the depressions, and if these play tables, e.g. during transport, are placed on edge, the toy building blocks drop out of the storage depressions.

The invention provides a play table which does not have this drawback, but which is suitable for storing the toy building blocks also during transport of the play table when the table top is on edge. Further, the play table of the invention will not tumble over during play, and the play table meets relevant safety standards.

Figure 1:
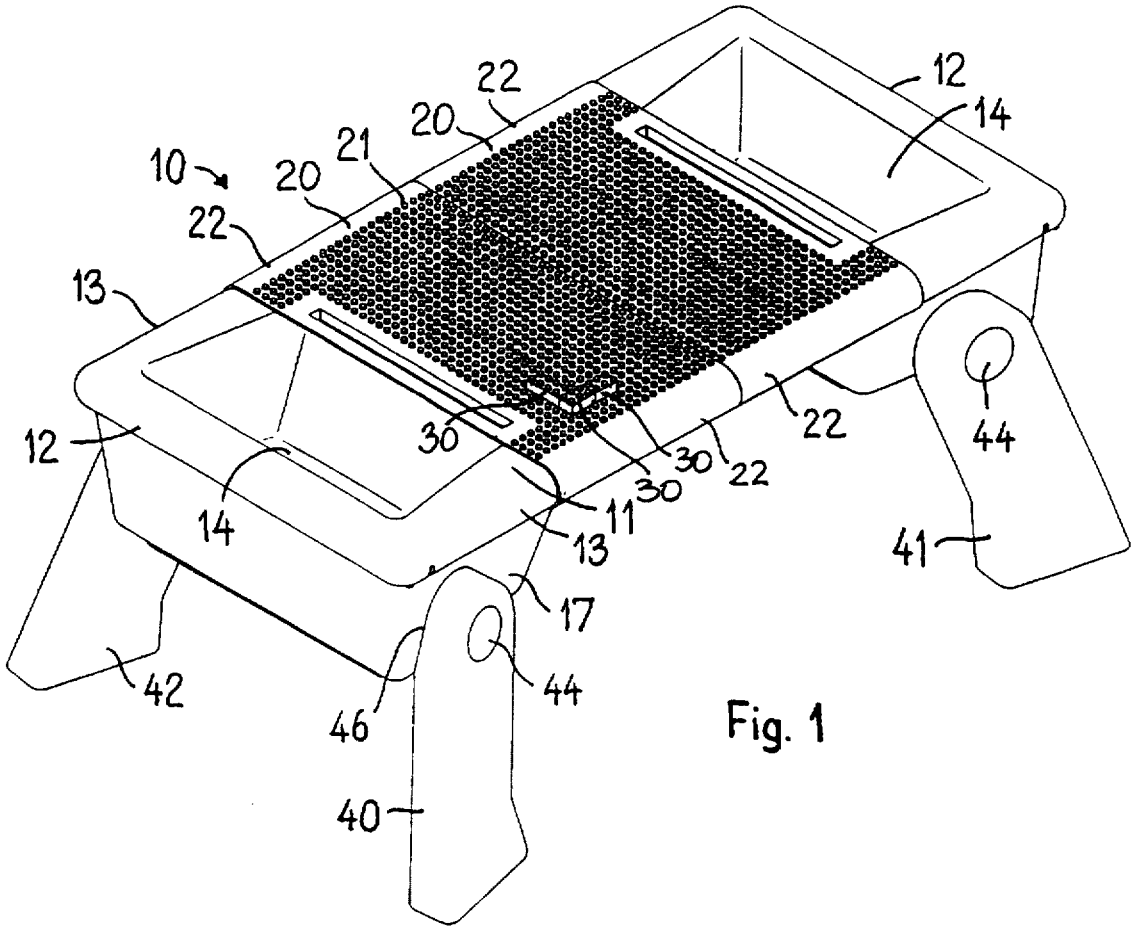
Figure 2:
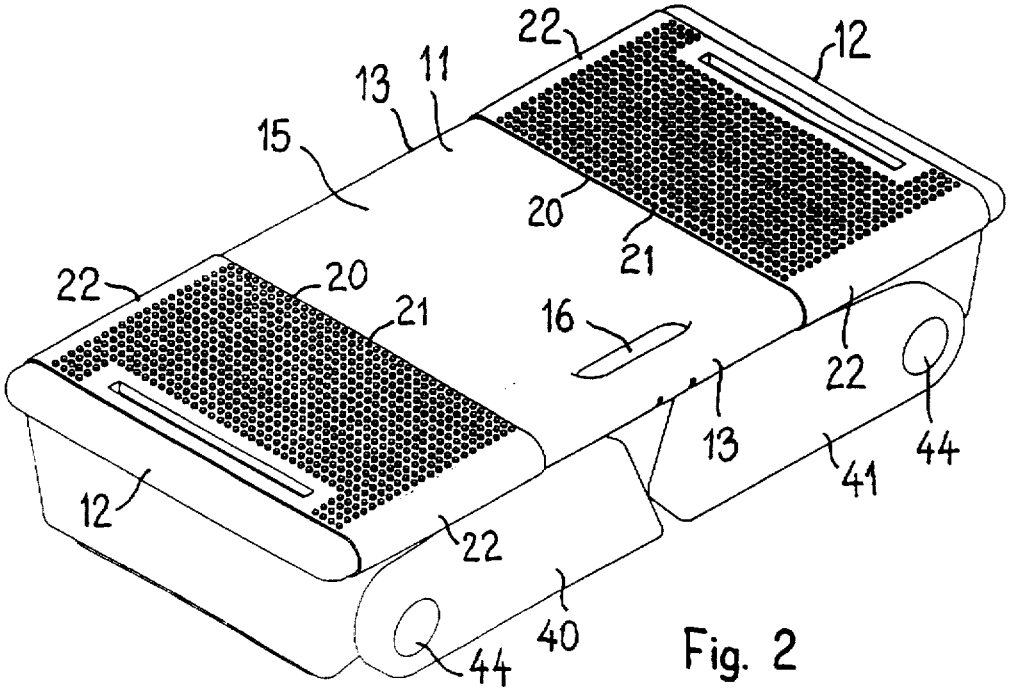
Figure 3:
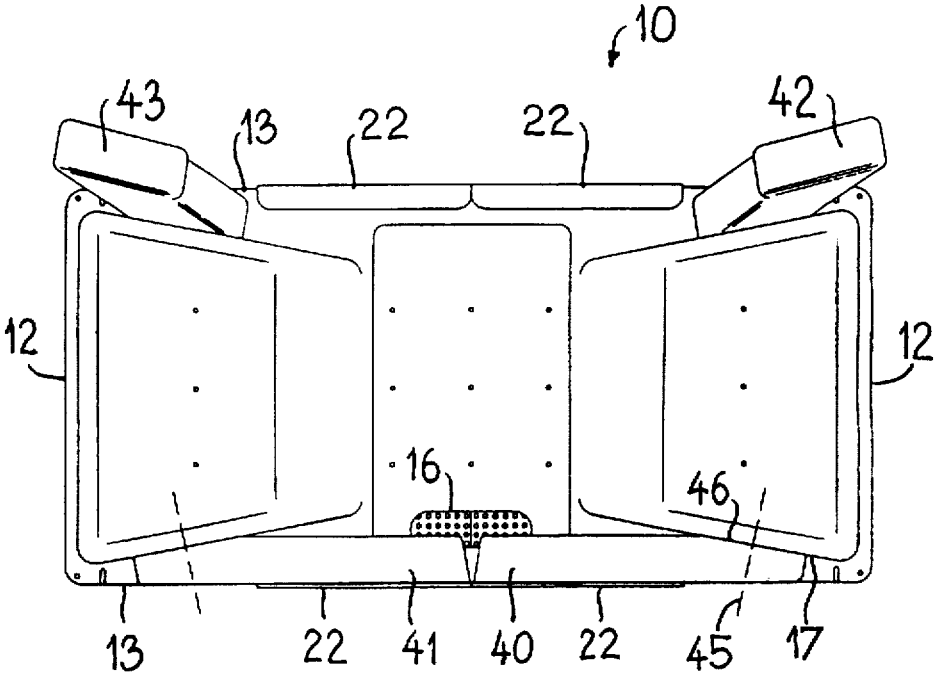

A preferred embodiment of the play table of the invention will be described more fully below with reference to the drawing, in which FIG. 1 is a perspective view of a play table according to the invention in a position assumed by the play table when a child plays at the table, FIG. 2 is a perspective view of the play table of FIG. 1 in a position assumed by the play table when a child does not play at the table, FIG. 3 is a bottom view of the play table of FIGS. 1 and 2.

The figures show a play table 10 which, in FIGS. 1 and 2, upwardly has a rectangular tabletop 11 having two opposed short edges 12 and two opposed long edges 13. The edges 12 and 13 are rounded and have a diameter approximately corresponding to the thickness of the tabletop 11.

At each of the short edges 12, the upper side of the tabletop is formed with a depression 14 which has a bottom and side walls and is open upwardly. The tabletop 11 has a plane central part 15 between the two depressions 14.

The upper side of the tabletop is provided with two uniform, rectangular building plates 20 having, on their upper side, projecting cylindrical knobs 21 which form a two-dimensional modular pattern in orthogonal rows. The building plates 20 with cylindrical knobs 21 are of a known type as such, since they are known from toy building sets which include toy building blocks having on one side projecting knobs of the same type as on the building blocks 20, such known building blocks having on another side coupling means which are complementary to the cylindrical knobs so that the toy building blocks may partly be built together with each other, partly be built on the cylindrical coupling knobs 21 on a building plate 20 by frictional engagement between the building knobs of a building plate and the complementary coupling means of the toy building elements. One of the building plates 20 is shown in FIG. 3 with three such toy building blocks 30 which are built on the knobs 21 on the building plate.

When the play is over, the toy building blocks 30 are removed from the building plate 20, and they can then be placed in one of the depressions 14, which hereby serve as storage depressions in the same manner as in the above-mentioned known play tables.

The two building plates 20 are extended beyond the area which has cylindrical coupling knobs 21, so that two opposed end portions 22 of each of the building plates 20 are bent down about respective ones of the long edges 13 of the tabletop, so that the end portions 22 squeeze preferably the upper side and under side of the tabletop with slight friction. Since the end portions 22 are bent around the edges 13, the building plates 20 are protected against falling off, and the building plates 20 may moreover be slidably moved along the long edges 13 of the tabletop between the position shown in FIG. 1 in which the two building plates together cover the plane central part 15 of the tabletop and provide access to the two storage depressions 14, and the position shown in FIG. 2 in which the two building plates 20 are arranged so as to cover respective ones of the storage depressions 14 completely. In FIG. 1 the storage depressions 14 are open, and the position of the building plates is therefore called their open position, and in FIG. 2 the storage depressions are closed, and the position of the building plates is therefore called their closed position.

After finished play with the toy building blocks 30, these are removed from the building plates 20 and are placed in the storage depressions 14, and the building plates 20 are moved from their open position in FIG. 1 to their closed position in FIG. 2.

The playtable 10 has four legs 40, 41, 42 and 43 arranged in pairs on opposite outer sides 17 of the storage depressions 14. The legs 40–43 are rotatably mounted by means of relatively thick shafts 44, two end portions of which are shown in FIGS. 1 and 2, and the shafts extend to the inner sides of the corresponding side walls of the storage depressions 14. The legs 40–43 are shown in FIG. 1 in a position in which they are unfolded so that the playtable 10 can stand on a substrate such as a floor by means of the legs, and in FIG. 2 the legs are shown in a position in which they are folded up so as to lie below the tabletop 11 and along respective ones of the long edges 13.

As shown in FIGS. 2 and 3, an elongate through opening 16 is provided in the plane central part 15 of the tabletop near one of the long edges 13. In the open position of the building plates 20 in FIG. 1 these cover the opening 16, and in the closed position of the building plates 20 in FIGS. 2 and 3 the opening 16 is accessible so that the opening 16 provides a carrier handle by means of which the play table can be carried. The adjacent one of the long edges 13 hereby faces upwardly so that the play table is on edge, and because, in this position, the building plates 20 cover both storage depressions 14, toy building blocks and other articles placed in the storage depressions 14 cannot fall out.

In FIG. 3 the legs 40 and 41 are shown in their folded-up position like in FIG. 2, while the legs 42 and 43 are shown in their unfolded position like in FIG. 1. At its end near its axis of rotation 45 the leg 40 has the shape of an acute-angled wedge, since it has a plane engagement face 46 forming an acute angle with the outer side of the leg 40. The plane engagement face 46 of the leg 40 is positioned close to a corresponding plane engagement face 17 on the outer side of the storage depression 14 concerned—see also FIG.

1. The plane engagement faces 17 and 46 are in close sliding contact with each other so that the leg 40 can rotate about an axis of rotation 45 which is perpendicular to the adjacent engagement faces 17 and 46. It will be seen that the engagement face 46 of the leg forms an acute angle with the longitudinal direction of the leg, and the engagement face 17 forms an acute angle with the long edges 13 of the table. This may also be expressed in the manner that the axis of rotation of the leg forms an angle different from 90° with the long edges 13 of the tabletop as well as with the longitudinal direction of the table leg.

The two legs 40 and 41 are shown in FIG. 3 in a position in which they are disposed in parallel with the long edges 13 of the tabletop. Unfolding of the legs causes these to describe part of a conical face, because, as mentioned, the axis of rotation 45 is inclined with respect to the longitudinal direction of the legs. The same applies to all four legs 40–43 of the table, and in the unfolded position assumed by the legs 42–43 in FIG. 3 the legs slope, as shown in FIG. 1, so that their lower ends are present outside the long edges 13 of the table top. This is of importance to the stability of the table during play, since the free ends of the table legs, which face downwardly in FIG. 1, define a supporting face which is larger than the surface of the table top 11 and protrudes beyond it. This provides enhanced security against overturning of the play table, if e.g. a child stands or sits on the tabletop near one of its edges, because the vertical projection of such a load on this substrate will always be within the supporting face, which is defined by the support faces of the table legs on the substrate.

The table legs are provided with end stops having click indication in their unfolded position in FIG. 1 as well as in their folded-up position in FIG. 2.

We claim:

1. A play and storage table comprising:

a table top, said table top having opposed end edges;

a first storage depression disposed between said end edges and extending downwardly from said table top; and a first sliding lid secured to said table and shiftable across said table top toward and away from said end edges between a closed position overlying said table top first depression and an open position uncovering said table top first depression, said first sliding lid remaining entirely between said end edges in both said closed and open positions, said first sliding lid having on a top surface thereof a first type of coupling means for interconnection with toy building elements having mating coupling means thereon.

2. A play table in accordance with claim 1 wherein said table top includes opposed longitudinal edges extending between said end edges and said sliding lid includes longitudinal sides that extend downwardly and around said table top longitudinal edges whereby to secure said first sliding lid to said table top, said slidable lid being shiftable in a direction parallel to said table top longitudinal edges.

3. A play table in accordance with claim 1 comprising a second storage depression disposed between said table top end edges and symmetrically arranged with said first storage depression and further comprising a second sliding lid secured to said table and shiftable across said table top toward and away from said end edges between a closed position overlying said second depression and an open position uncovering said table top second depression, said second sliding lid remaining entirely between said end edges in both said closed and open positions, said second sliding lid having on a top surface thereof said first type of coupling means for interconnection with toy building elements having mating coupling means thereon.

4. A play table in accordance with claim 3 further comprising a carrier handle formed in said table top between said end edges, said carrier handle underlying at least one of said first and second sliding lids when said first and second sliding lids are in their open positions and being accessible only when at least one of said first and second sliding lids is in its closed position.

5. A play table (10) according to claim 1, characterized in that it has table legs (40, 41, 42, 43) which are arranged on outer sides (17) of depression.

6. A play table (10) according to claim 5, characterized in that the legs (40, 41, 42, 43) are mounted so as to be pivotable between a folded-up position in which they are disposed along the table top (11), and an unfolded position in which they protrude downwardly from the table top (11).

7. A play table (10) according to claim 6, characterized in that the axis of rotation (45) of each leg (40, 41, 42, 43) forms an angle different from 90° with one of the edges (13) of the tabletop as well as with the table leg (40, 41, 42, 43).

* * * * *